US006092940A

United States Patent [19]

Wiklof et al.

[11] Patent Number: 6,092,940

[45] Date of Patent: Jul. 25, 2000

[54] PRINTER WITH PRINTING MEDIUM MOTION DETECTION

[75] Inventors: Christopher A. Wiklof, Everett; Joseph R. Wade, Monroe, both of Wash.

[73] Assignee: Intermec IP Corporation, Beverly Hills, Calif.

[21] Appl. No.: 09/100,259

[22] Filed: Jun. 19, 1998

Related U.S. Application Data

[63] Continuation of application No. 08/623,458, Mar. 28, 1996, abandoned.

[51] Int. Cl.[7] ..... B41J 3/36

[52] U.S. Cl. ..... 400/88; 347/16; 400/709; 400/120.01; 400/613

[58] Field of Search ..... 347/16; 358/296, 358/473; 400/88, 582, 578, 613, 596, 613.1, 708, 708.1, 709, 120.01

[56] References Cited

U.S. PATENT DOCUMENTS

| | | | |
|---|---|---|---|
| 3,767,020 | 10/1973 | Rowe | 197/1 R |
| 4,372,695 | 2/1983 | Ross | 400/119 |
| 4,427,314 | 1/1984 | Fujiwara et al. | 400/338.2 |
| 4,443,925 | 4/1984 | Fujiwara et al. | 400/88 |
| 4,523,235 | 6/1985 | Rajchman | 358/256 |
| 4,547,780 | 10/1985 | Cummings | 346/9 |
| 4,610,445 | 9/1986 | Schneider et al. | 271/40 |
| 4,649,403 | 3/1987 | Miura | 346/160 |
| 4,662,765 | 5/1987 | Kapp et al. | 400/595 |
| 4,669,052 | 5/1987 | Lemelson | 101/110 |
| 4,750,049 | 6/1988 | Murakami et al. | 358/296 |
| 4,819,083 | 4/1989 | Kawai et al. | 358/294 |
| 4,851,896 | 7/1989 | Muranaga et al. | 359/296 |
| 4,851,921 | 7/1989 | Sato et al. | 358/474 |
| 4,862,281 | 8/1989 | Sato et al. | 358/400 |
| 4,887,165 | 12/1998 | Sato et al. | 358/474 |
| 4,897,730 | 1/1990 | Yanagawa et al. | 358/473 |
| 4,899,228 | 2/1990 | Sano et al. | 358/473 |
| 4,903,232 | 2/1990 | O'Connell et al. | 364/900 |
| 4,915,027 | 4/1990 | Ishibashi et al. | 101/486 |
| 4,928,183 | 5/1990 | Yajima | 358/296 |
| 4,947,262 | 8/1990 | Yajima et al. | 358/296 |
| 4,949,283 | 8/1990 | Yamauchi et al. | 364/519 |
| 4,999,016 | 3/1991 | Suzuki et al. | 400/88 |
| 5,020,928 | 6/1991 | Akiyama et al. | 400/120 |
| 5,024,541 | 6/1991 | Tsukada et al. | 400/88 |
| 5,052,832 | 10/1991 | Akiyama et al. | 400/120 |
| 5,079,639 | 1/1992 | Mochinaga | 358/473 |
| 5,112,149 | 5/1992 | Suenaga | 400/88 |
| 5,131,090 | 7/1992 | Fukushima | 395/700 |
| 5,240,334 | 8/1993 | Epstein et al. | 400/88 |
| 5,638,098 | 6/1997 | Iwata et al. | 347/9 |

FOREIGN PATENT DOCUMENTS

| | | |
|---|---|---|
| 361035291 | 2/1986 | Japan . |
| 363290780 | 11/1988 | Japan . |

*Primary Examiner*—Christopher A. Bennett
*Attorney, Agent, or Firm*—Perkins Coie LLP

[57] ABSTRACT

A printer for printing on a manually moved print medium. The printer may use thermal or inkjet printing and has user feedback and input. A roller-type position detector enables the printer to be used without a mechanical paper drive mechanism. The printer monitors the print medium as the print medium is propelled through the printer to identify when particular printing fields are aligned to the printhead. The printer then activates the printhead to print image portions in the printing fields. An alternative embodiment of the printer uses a flexible mounting of the printhead. In this embodiment, the paper roll diameter is determined in conjunction with monitoring the rotation of the paper roll to determine the position of the paper without requiring a roller-type position detector.

39 Claims, 4 Drawing Sheets

PRINTER WITH PRINTING MEDIUM MOTION DETECTION

CROSS REFERENCE TO RELATED APPLICATION

This application is a continuation of U.S. patent application Ser. No. 08/623,458, filed Mar. 28, 1996, now abandoned.

TECHNICAL FIELD

The present invention relates to printers such as printers used for printing bar code symbologies and other images.

BACKGROUND OF THE INVENTION

Typically, printers require a supply of a print medium, such as paper, to be loaded into the printer and controllably moved through the printer. The paper is typically supplied as either a continuous stream of paper or as individual sheets. The paper is then fed into the printer using a set of drive rollers which frictionally engage the paper and propel it through the printer along a predetermined path. The drive rollers often are coupled to a stepper motor which drives the drive rollers in small increments or steps such that the paper is propelled incrementally or stepped through the printer, pausing slightly between each step. As the paper is stepped through the printer, it passes a conventional printhead having a linear array of elements such as a thermal printhead or an inkjet printhead. During each pause between steps, a small portion of the paper is aligned with the printhead. During this pause selected elements of the printhead are activated to produce a portion of an image on the portion of the paper aligned with the printhead.

The image portion is a small portion of an entire image to be printed. The entire image typically is produced by stepping the paper past the printhead, pausing the paper after each step, determining a step number (e.g., fifth step or sixth step) corresponding to the pause, determining the portion of the image corresponding to the step number, determining which elements to activate to produce the determined portion of the image, and activating the determined elements to produce the determined portion of the image. A microprocessor controls the operation.

To produce the entire image accurately, the distance the paper is propelled for each step must be controlled precisely. Further, the step number must be monitored continuously to enable the location of the paper relative to the printhead to be precisely determined.

This control of the paper position and monitoring of the step number is typically achieved with a stepper motor with precisely defined step sizes and by digitally controlling the stepper motor with a microprocessor motor controller. The timing of the printer must also be controlled accurately, so that the printhead is activated during the pauses between steps.

The need for such stepper motors, digital controllers and timing control greatly increase the weight, complexity and cost of printers. Also, monitoring the step number and correlating it to the controlled stepping of the stepper motor requires considerable microprocessor time.

SUMMARY OF THE INVENTION

The present invention overcomes the limitations of the prior art by providing a printer capable of printing relatively complex images of indefinite and variable size and a high degree of uniformity directly onto a print medium passed through the printer without requiring an accurately controlled stepper motor or other print medium driver with its associated weight, complexity, cost, and interface and processing requirements.

The paper may be propelled by hand from outside of the printer. The means of propelling the paper through the printer is independent of electronic control by the printer. By divorcing the paper driving means from the printer electronic control, the printer eliminates the need for a printer-to-paper drive interface.

The printer in its preferred embodiment determines the position of the print medium mechanically by engaging a first roller to the print medium and coupling the first roller to a rotational sensor. Based upon the detected position of the print medium, the printer identifies a small field on the print medium aligned with the printhead and a corresponding image portion to be printed on the field. The printhead is then energized in response to the identified image portion to print the image portion. The process is repeated for successive image portions until an entire image is printed.

To improve the accuracy of the mechanically determined position and to limit misalignment, the first roller is an elongated cylinder which resists side slippage of the print medium. To minimize longitudinal slippage, the first roller includes an outer surface adapted to frictionally engage the print medium. A second roller having a similar outer surface is aligned with the first roller. The first and second rollers sandwich the print medium between them, further reducing the possibility of any side or longitudinal slippage.

In an alternative embodiment, the print medium is paper supplied from a roll and the printer measures the paper position by monitoring the rotational angle and diameter of the paper roll. The printer then calculates the position of the paper from these measurements.

Because the printer detects the position of the print medium directly, no mechanical paper drive or other controllable print media feed source is required. The printed image achievable with the printer is not limited in size to the printing element size. Because the printer uses an accurate, location-based printhead activation, it provides a uniform, repeatable image. The printer can therefore be used to print bar codes and other images of varying lengths.

DETAILED DESCRIPTION OF THE INVENTION

Figure 1:
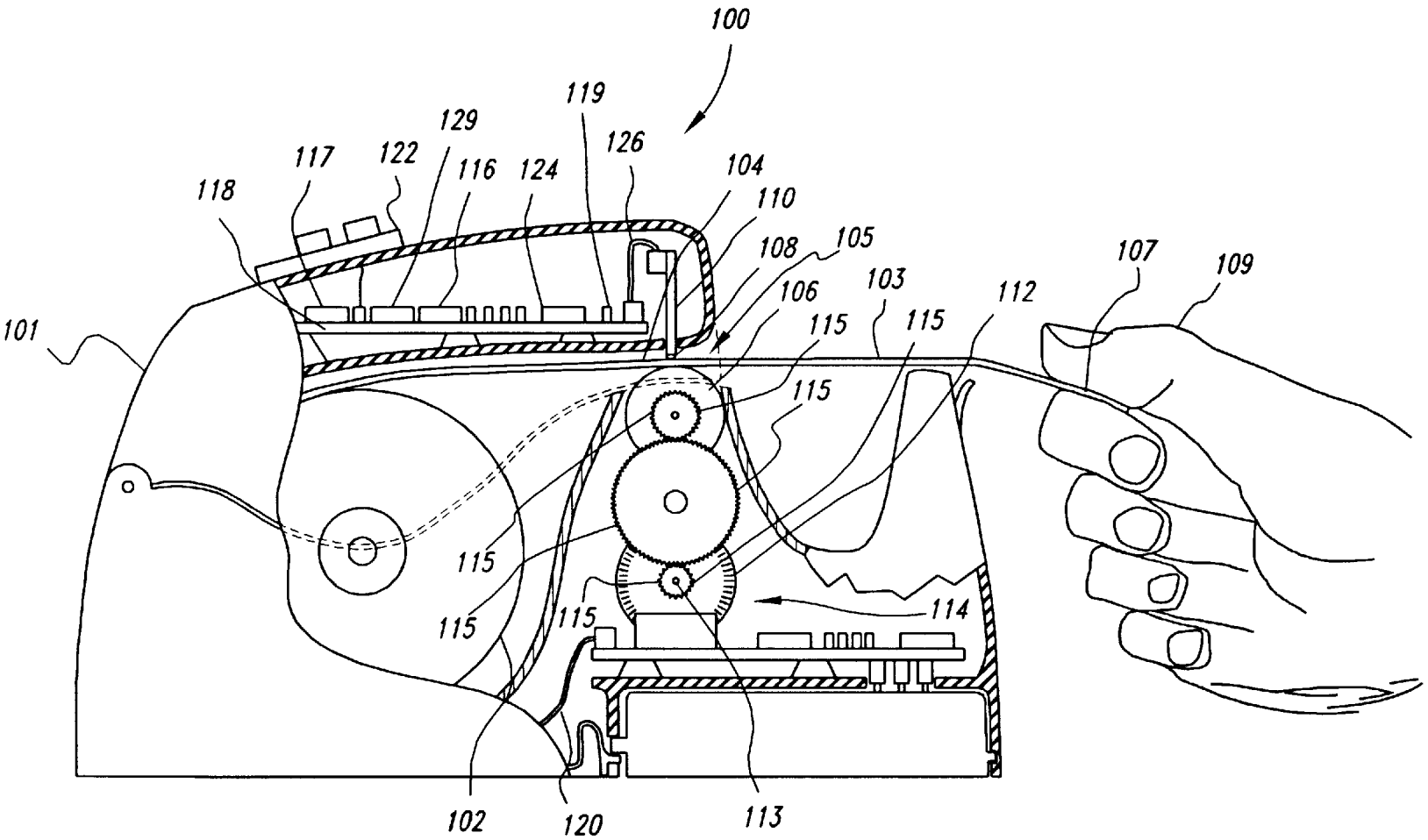
FIG. 1 is a cross-sectional, side elevational view of a preferred embodiment of the inventive printer.

A printer 100 according to the present invention, shown in FIG. 1, is embodied in a housing 101 shaped similar to a common transparent tape dispenser. As will be seen from the following discussion, the printer does not require a stepper motor and associated control elements to print an image. Instead, the printer detects motion of a print medium as it is propelled by an external force through the printer. Based upon the detected motion, the printer identifies successive portions of the print medium as they pass through the printer and prints a portion of an image on each successive print medium portion. Together, the successive image portions form the entire image.

In the embodiment of FIG. 1, a paper roll 102 is positioned within the housing 101 to provide a continuous length of paper 103 which forms the print medium upon which the image is printed. The paper follows a paper path 104 through the printer 100 from the paper roll to an elongated rotatable cylindrical roller 106 and out of the housing through a paper port 105 where it is accessible for grasping by the hand of a user 109 to propel the paper along the paper path by pulling on a free end 107 of the paper.

At the roller 106, the paper 103 passes between the roller and a linear array of print elements 108 within a conventional thermal printhead 110. As the paper passes by the printhead, the paper is held in thermal contact with the printhead by pressure between the printhead and the roller. Because the roller is an elongated cylinder, it provides a wide area of contact with the paper to minimize side or longitudinal slippage of the paper relative to the roller.

The printing process used by the printer 100 may be divided into three related aspects, first, detection of movement of the paper 103 to determine the portion of the paper aligned with the printhead 110; second, identification of an image portion to be printed on the determined portion of the paper; and third, activation of the printhead to print the image portion on the determined portion of the paper. The first aspect of the printing process, detection of the paper movement, is initiated when the paper 103 from the paper roll 102 is pulled along the paper path 104 by the user 109 who grasps and pulls the protruding free end 107 of the paper, providing motion to the paper. As the paper travels between the roller 106 and the printhead 110, friction between the paper and the roller causes the roller to turn.

The rotation of the roller 106 is translated through a series of toothed gears 115 into rotation of an encoder wheel 112 within a rotation sensor 114. In the manner discussed in greater detail below with respect to FIG. 2, the rotation sensor 114 converts the rotational movement of the encoder wheel 112 into a digital electrical signal indicative of rotation of the roller. The digital signal from the rotation sensor is input to a microprocessor 116 on a printed circuit board 118 via a cable 120. The microprocessor decodes the digital signal indicative of the rotation of the roller and from that information, determines the position of the paper 103 along the paper path 104.

Figure 2:
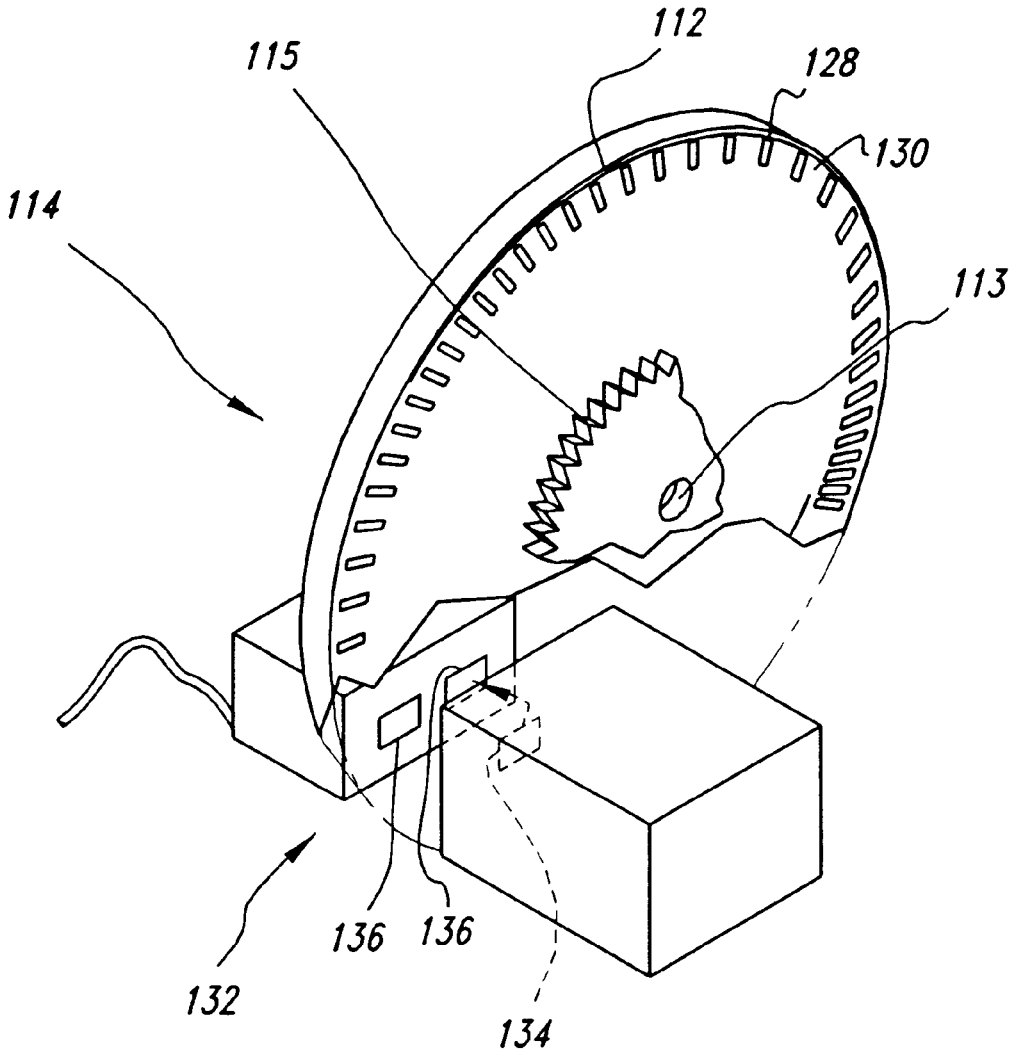
FIG. 2 is an enlarged fragmentary view of a rotation sensor used in the printer of FIG. 1.

The measurement of rotation of the roller 106 by the rotation sensor 114 is best demonstrated by reference to FIG. 2. The rotation sensor includes two main components, the encoder wheel 112 and an optical detector 132 for monitoring the rotation of the encoder wheel. The encoder wheel 112 is mounted on an encoder axle 113 coaxial with one of the toothed gears 115 such that, as the toothed gears turn, the encoder wheel turns with them. Because the toothed gears link the encoder wheel to the roller 106, rotation of the roller causes corresponding rotation of the encoder wheel. Alternating transmissive and opaque regions 128 and 130, respectively, are circumferentially spaced along the perimeter of the encoder wheel.

The optical detector 132 includes an optical source 134 (shown in broken line) and a pair of optical receivers 136 to monitor the movement of the transmissive and opaque regions 128 and 130 giving an indication of rotation of the encoder wheel 112. The optical source and receivers are a conventional light-emitting diode (LED) and photo detectors, respectively, which are positioned such that the transmissive and opaque regions of the encoder wheel pass between the optical source and receivers. As the encoder wheel turns, light from the optical source 134 is alternately transmitted through the transmissive regions 128 to the receivers 136 and blocked by the opaque regions 130 producing an alternating light signal to the receivers 136. In response to the alternating light, the receivers produce signals corresponding to the angular rotation of the encoder wheel which correspond to the distance traveled by the paper 103 as it rotates the roller 106. The rotation sensor 114 thus produces an electrical signal indicative of the motion of the paper for input to the microprocessor 116 (see FIG. 1).

Referring again to FIG. 1, the microprocessor 116 monitors the signals from the rotation sensor 114 and calculates the distance traveled by the paper 103. To calculate the distance traveled by the paper, the microprocessor first identifies a starting location, such as the start of a sheet of paper or an arbitrarily selected start of an image location. The microprocessor then monitors the signals from the rotation sensor to calculate the distance traveled by the paper. From these determinations, the microprocessor determines when successive portions of the paper are aligned to the printhead 110. The microprocessor then determines a desired image portion to be printed on each successive portion of the paper and identifies an appropriate energization signal for the printhead to produce the desired image portion.

To identify the desired image portion to be printed, the microprocessor 116 retrieves data from a bit map of image data stored in a memory 117 having several memory locations, each corresponding to a pixel of the image. Each memory location contains a data bit or sequence of data bits corresponding to the memory location's respective individual pixel, with each such data bit or sequence of data bits representing the printing or not printing of the pixel. For example, a logic level "1" may correspond to printing the particular pixel and a logic level "0" may correspond to not printing the particular pixel. The pixels of the image thus map in a one-to-one relationship to locations in the memory 117 containing data bits (i.e., a "bitmap").

The data is retrieved from the memory 117 on a line-by-line basis. That is, a data bit or sequence of data bits for each element in the array of print elements 108 of the printhead 110 is retrieved and loaded as a group into a buffer 119 for printing. The portion of the paper to which the printhead 110 is aligned contains a plurality of regions, each aligned to one of the print elements 108. All of the print elements may be activated simultaneously to print a narrow portion (i.e., a line) of the image, with each of the regions representing a single pixel of the image to be printed (or not printed) while the printhead is aligned to the portion of the paper 103. The microprocessor 116 determines whether or not to print each pixel based upon the determination of the portion of the paper to which the printhead is aligned, and the position of each print element in the printhead.

To actually print the desired portion of the image, the data bits or sequences of data bits retrieved from the location corresponding to the particular pixels in the desired image portion are sent to a buffer 119 and clocked into a printer driver 124 under control of the microprocessor 116. The printer driver then provides an energization signal to all of the print elements 108 in the printhead 110 through a printhead cable 126. In the thermal printhead of the preferred embodiment, the printer driver 124 includes current drivers and complementary logic components in accordance with conventional design.

The printer driver 124 is driven by the retrieved data in combination with a system clock signal under control of the microprocessor 116 to ensure proper timing and spacing of successive desired portions of the image to be printed. The microprocessor controls the spacing of successive desired portions of the image by first monitoring the temporal spacing between successive increments of motion of the paper to calculate the velocity of the paper 103 past the printhead 110, averaged over several recent intervals. Based upon the average velocity, the microprocessor estimates, in advance, when the printhead 110 will be aligned to each successive portion of the paper. Based upon the calculation, the microprocessor activates the printhead before the portion of the paper reaches the printhead, so that the print elements 108 will have sufficient time to heat to a printing temperature before the portion of the paper passes the printhead.

As each individual print element 108 is heated, the region of the paper 103 aligned to the particular print element is heated. The heat from the print element activates a thermally sensitive ink on the paper and produces the desired portion of the printed image. Alternately, a thermally sensitive print ribbon may be used, as is conventional for thermal printers. While the printhead is preferably a thermal printhead, other printing heads, such as inkjet printheads may be used. In such embodiments, the paper need not include a thermally sensitive coating or ink.

To provide adaptability to the printer 100, the microprocessor 116 is connected to receive input from a user through a keyboard 122 mounted on the exterior of the housing 101 or a similar input unit. For example, where the printer is used to print electro-optically readable symbologies, a user may select among various symbology types such as bar code symbologies or two-dimensional symbologies by entering appropriate commands through the keyboard. The user may also select among specific microprocessor programs or may input data to modify the image to be printed. For example, the user may input a user identifier number so that all images printed by the user will indicate the user. Also, the user may select font types for text or may adjust the printing parameters (e.g., maximum temperature, heating duration) to optimize printing for specific paper types or inks.

While the printer 100 is described herein as printing on paper 103 from the paper roll 102, the printer may use other print media, such as individual labels or separate sheets of paper. In particular, the printer may also be used to print and dispense printed adhesive labels bearing symbologies, such as bar code symbologies or two-dimensional symbologies. Similarly, the principles of the printer 100 can be applied, with appropriate scaling of components, to printing on other externally propelled media such as lumber in a lumber mill or packages on a conveyor belt. The paper 103 can also be adhesively backed to eliminate the need to "grasp" the paper 103. For example, ends of adhesively backed labels can be pressed to moving packages on a conveyor belt. As the packages move, the labels adhere to the packages and motion of the packages along the conveyor belt pulls the labels from the printer 100.

Also, while the preferred embodiment of the printer 100 incorporates a commercially available rotation sensor 114 using optical measurements of the motion of the encoder wheel 112, other devices and methods for producing an electrical signal indicative of position and/or velocity will be readily apparent to those skilled in the art.

Figure 3:
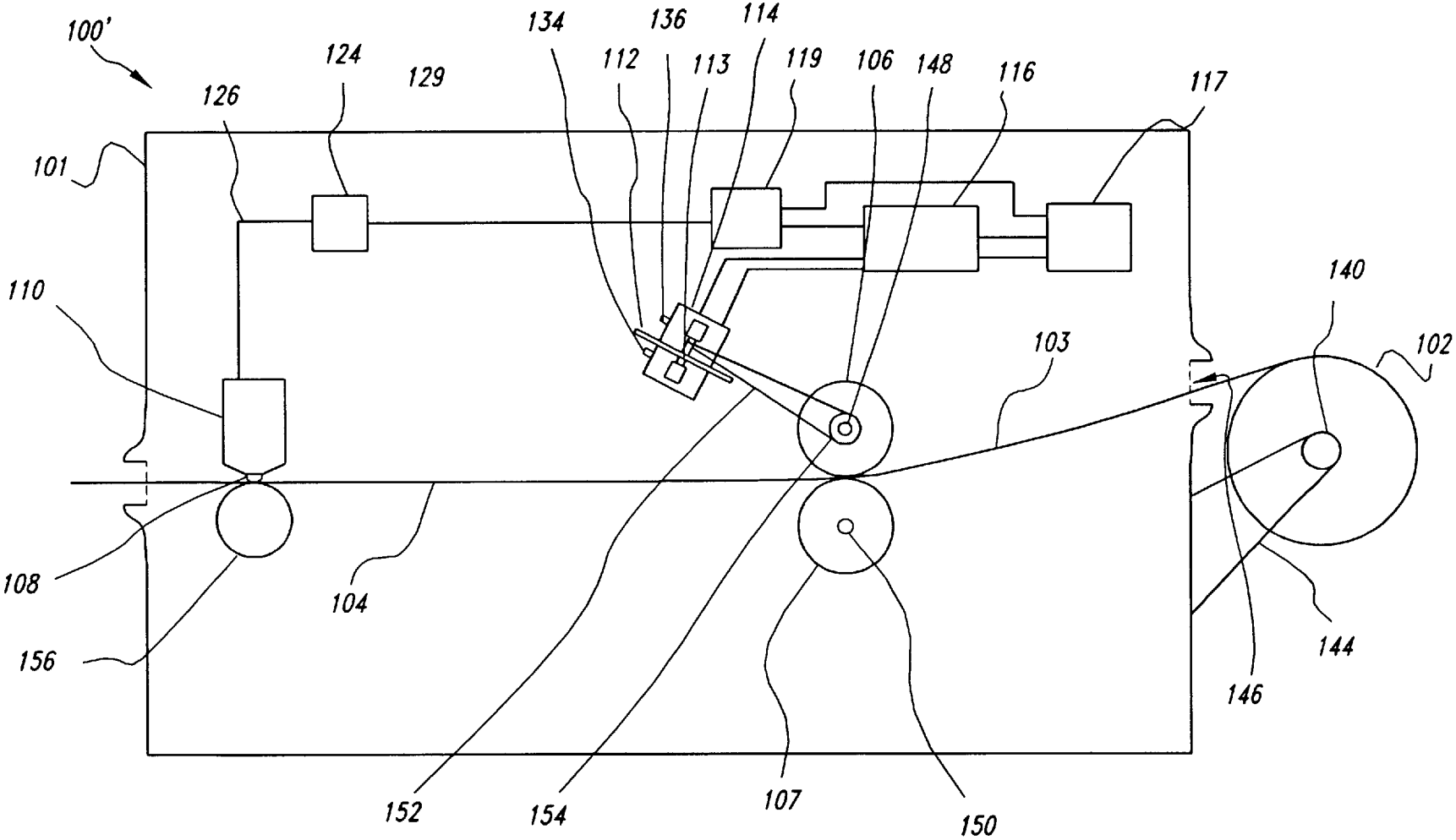
FIG. 3 is a schematic drawing of a first alternative embodiment of the printer of FIG. 1 using a belt-driven optical detector and a print medium supply external to the housing.

In a first alternative embodiment of the printer 100', shown schematically in FIG. 3, the printer monitors motion of the paper 103 at a location spaced apart from the printhead 110. To perform this measurement, the printer includes a facing roller 107 aligned with the roller 106. The roller 106 and facing roller 107 are rotatably mounted within the housing 101 on roller axles 148 and 150, respectively. To feed paper to the roller and facing roller, the paper roll 102 is supported by a detachable roll axle 140 mounted externally to the housing 101 by a bracket 144. The paper passes from the paper roll into the housing through an input paper aperture 146.

As the paper 103 enters the housing 101, the roller 106 and the facing roller 107 engage opposite sides of the paper 103. When the user pulls the paper and propels the paper through the printer, the roller and the facing roller are rotated by their frictional engagement with the paper. In this embodiment, rotation of the roller 106 is transmitted to the encoder axle 113 of the rotation sensor 114 through a belt 152 to produce corresponding rotation of the encoder wheel 112. The belt 152 is positioned on a pulley 154 attached for rotation with the roller 106. Rotation of the roller is then translated into an electrical signal by the rotation sensor 114 in similar fashion to that described above.

Upon receiving the electrical signal from the rotation sensor 114, the microprocessor 116 determines the rotational angle of the roller 106 and from this determines the position of the paper 103 along the paper path 104. From the determined position of the paper, the microprocessor identifies the portion of the paper to which the print elements 108 of the thermal printhead 110 are aligned.

As the paper 103 travels beyond the roller 106 and the facing roller 107, it passes between the printhead 110 and an engagement roller 156. The engagement roller provides pressure to the paper to maintain the paper in contact with the printhead 110. As above, printing is realized through energization of the elements 108 of the thermal printhead 110 through the printer driver 124 and the buffer 119 in response to data retrieved from the image bit map in the memory 117 by the microprocessor 116 and the calculated position of the paper.

Figure 4:
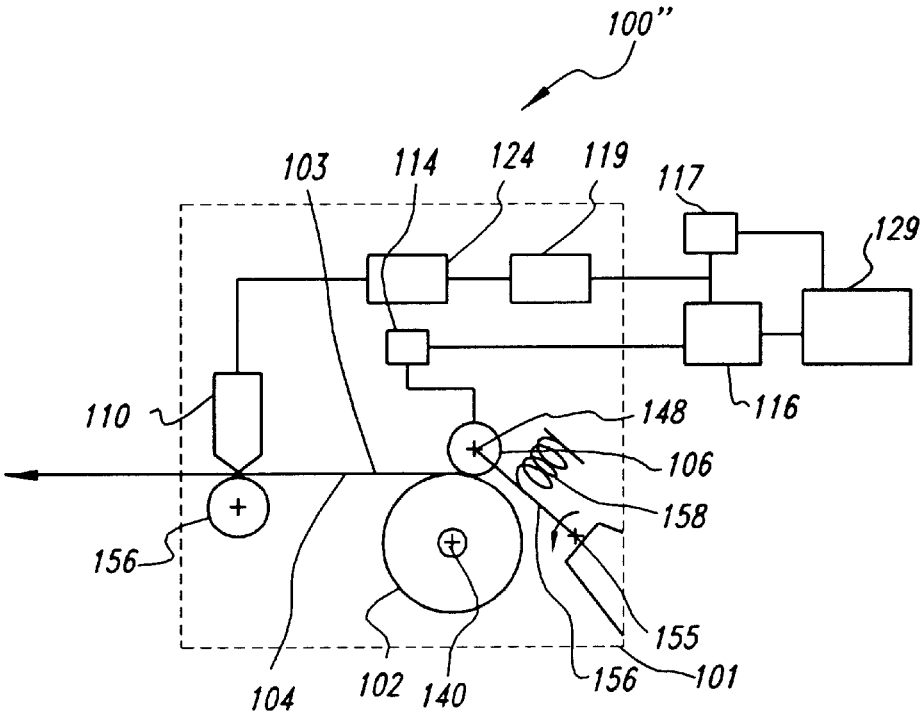
FIG. 4 is a schematic drawing of a second alternative embodiment of the printer of FIG. 1 using a rotation detector aligned to the print medium supply.

A schematic representation of a second alternative embodiment of the inventive printer 100 is shown in FIG. 4. In this embodiment, the roller 106 directly engages the paper roll 102, eliminating the need for the facing roller 107 described above.

The roller 106 is pivotably connected to the housing 101 by a mounting bar 156 which supports the roller axle 148 and is pivotably mounted to the housing 101 for rotation about a pivot axis 155. This arrangement permits the roller axle of the roller 106 to pivot around a pivot axis 155. The roller is biased toward engagement with the paper roll 102 using a bias spring 158 which exerts a force between the housing and the mounting bar, forcing the mounting bar to pivot around the pivot axis 155, and urge the roller into engagement with the paper roll. The flexible positioning permitted by the bias spring enables the roller to remain continuously engaged with the paper roll, despite the decreasing diameter of the paper roll as the paper is consumed by the printer 100". The continuous engagement causes the roller to move inwardly toward the center of the paper roll as the paper is consumed and the diameter of the paper roll correspondingly decreases.

The position of the paper 103 along the paper path 104 relative to the printhead 110 is determined in this second alternative embodiment from the rotation of the roller 106 with the rotation sensor 114 in substantially the same manner as described for the first alternative embodiment above. Also as before, the paper 103 is maintained in contact with the printhead 110 by the engagement roller 156 and energization of the printhead 110 is realized through the printer driver 124 under control of the microprocessor 116, in conjunction with the memory 117 and buffer 119.

Figure 5:
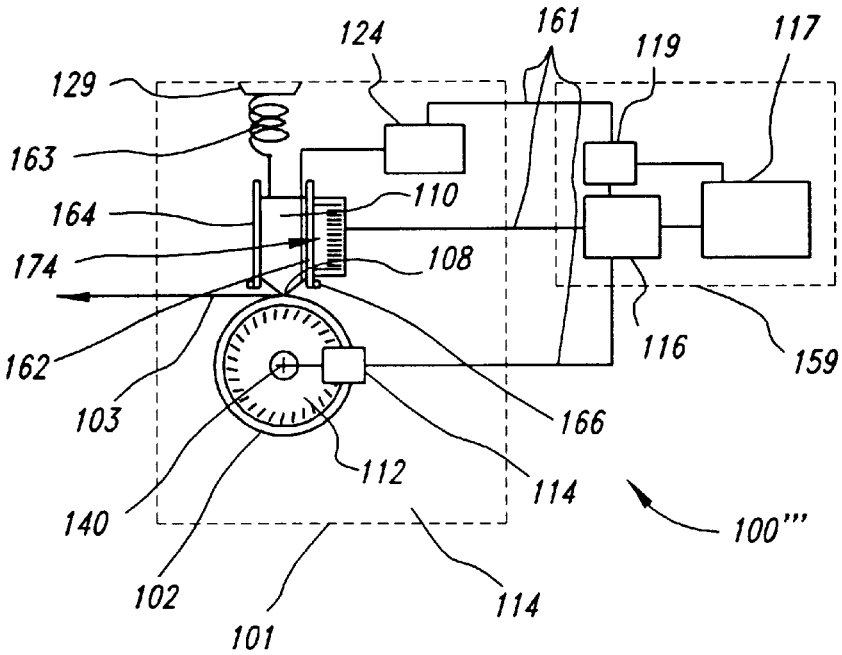
FIG. 5 is a schematic drawing of a third alternative embodiment of the printer of FIG. 1 using the printhead aligned to print directly on the print medium supply.

Shown schematically in FIG. 5 is a third alternative embodiment of the inventive printer 100"' where the printer directly monitors rotation of the paper roll axle 140 to determine the position of the paper 103. Also, in this embodiment, the microprocessor 116 and memory 117 are within a separate controller unit 159 separate from the housing 101 and connected to the housing by cables 161.

In this embodiment, the paper roll 102 is mounted within the housing 101 and the encoder wheel 112 is mounted coaxially with the paper roll such that the encoder wheel turns with the paper roll. The rotation sensor 114 then monitors the rotation of the paper roll, by monitoring the encoder wheel directly rather than monitoring the rotation of a frictionally engaged roller. The rotational position of the encoder wheel 112 is determined in a similar manner as described above for the embodiments of FIGS. 1–4. That is, the microprocessor 116 receives a signal from the rotation sensor 114 and calculates the distance traveled by the paper. In this embodiment, however, the mathematical algorithm used by the microprocessor to calculate the position of the paper is adapted to compensate for the varying diameter of the paper roll 102 with distance traveled by the paper determined according to the formula:

Distance=(paper roll diameter/2)*(angle of rotation (in radians))

The paper roll diameter is determined with a paper diameter monitor 162 mechanically coupled to the printhead 110, as described below.

To maintain the engagement of the printhead 110 with the paper 103, the printhead is movably supported by the housing 101 and biased to move toward the paper roll 102 by a printhead bias spring 163, eliminating the need for an engagement roller. The printhead is permitted to slide between a pair of printhead guides 164, 166. The guides are mounted to the housing in a fixed position relative to the paper roll axle 140. The printhead can slide radially with respect to the paper roll axle and is biased toward engagement with the paper roll by the printhead bias spring. As the user pulls the paper 103 from the printer 100, the paper is consumed and the diameter of the paper roll is reduced. The biasing force of the printhead bias spring causes the printhead to slide within the printhead guides and remain engaged with the paper roll.

The paper diameter monitor 162 monitors the paper roll diameter by monitoring the position of an opaque member 174 rigidly connected to the printhead 110. The position of the opaque member is determined in a conventional manner, such as with an illuminating light source and a linear array of detectors positioned on opposite sides of the opaque member, to provide an electrical indication of the paper roll diameter to the microprocessor 116.

The microprocessor 116 calculates the position of the paper 103 based upon the signal from the paper diameter monitor 162 and the signal from the rotation sensor 114. As with the above-described embodiments, the microprocessor then controls printing by controlling energization of the printhead 110 in conjunction with the printer driver 124 and buffer 119 in response to data retrieved from the memory 117.

It will be appreciated that, although specific embodiments of the invention have been described herein for purposes of illustration, various modifications may be made without departing from the spirit and scope of the invention. For example, although the embodiments described herein rely upon a user grasping the paper 103 to propel the paper 103 along the paper path 104, other methods of propelling the paper 103 with an external source may be within the scope of the invention. For example, if the paper 103 is paper moving through a newspaper printing press, the paper 103 is propelled by the printing press equipment. Similarly, if the paper 103 is adhesively backed and pressed into contact with a moving object, such as a package on a conveyor belt, engagement of the paper 103 to the package can pull the paper 103 from the printer 100. If the print medium is not paper, but a piece of wood being processed by equipment in a lumber processing facility, processing equipment can provide motion of the print medium. Accordingly, the invention is not limited except as by the appended claims.

What is claimed is:

1. A printer for printing on a print medium supplied from a print medium roll, comprising:

a housing with a print medium path therethrough along which the print medium travels, the print medium path exposing the print medium for grasping by a user to manually propel the print medium along the print medium path;

a printing member supported by the housing and positioned to print on the print medium as the print medium is manually propelled along the print medium path;

a position detector supported by the housing and oriented to monitor the position of selected portions of the print medium as the print medium is manually propelled along the print medium path and to generate an electrical signal indicative of the position of selected portions of the print medium in response to the movement of the print medium along the print medium path, the position detector including a first roller movably supported by the housing and positioned to continuously frictionally engage the print medium on the print medium roll, the first roller rotating in correspondence with the movement of the print medium along the print medium path; and a print controller microprocessor connected to receive the electrical signal from the position detector, and connected to selectively activate the printing member for printing in response to the electrical signal on the selected portions of the print medium.

2. A printer for printing on a print medium, comprising:

a housing with a print medium path therethrough along which the print medium travels;

a printing member supported by the housing and positioned to print on the print medium as the print medium is manually propelled along the print medium path;

a position detector supported by the housing and oriented to monitor the position of selected portions of the print medium as the print medium is propelled along the print medium path and to generate an electrical signal indicative of the position of selected portions of the print medium in response to the movement of the print medium along the print medium path wherein the position detector includes a platen roller opposed to the printhead and frictionally engaging the print medium, the platen roller rotating in correspondence with the movement of the print medium along the print medium path.

3. The printer of claim 1 wherein the position detector further includes a rotation sensor connected to monitor the rotation of the first roller and to produce the electrical signal indicative of movement of the print medium along the print medium path.

4. The printer of claim 3 wherein the rotation sensor includes:

an encoder wheel having a plurality of apertures through a portion thereof connected to rotate in correspondence to rotation of the first roller;

an optical source emitting light toward the portion of the encoder wheel having the apertures therethrough; and an optical detector positioned to detect light from the optical source transmitted through the apertures and producing the electrical signal in response thereto.

5. The printer of claim 3 wherein the first roller is movable to continuously engage the print medium roll.

6. The printer of claim 1, further including a radius detector positioned to detect the radius of the print medium roll.

7. The printer of claim 6 wherein the radius detector is a printing member position sensor coupled to monitor the position of the printing member relative to a central axis of the print medium roll.

8. The printer of claim 1 wherein the print controller includes:

a memory containing image data representing an image to be printed; and wherein the controller is a microprocessor connected to retrieve the image data and to activate the printing member in response to the retrieved image data.

9. The printer of claim 8 wherein the image data in the memory includes a plurality of discrete image data portions, each corresponding to a portion of the image and wherein the microprocessor is programmed to identify the selected portion of the print medium aligned with the printing member based upon the electrical signal indicative of the position of the print medium and to retrieve the image data portion corresponding to the identified selected portion of the print medium.

10. The printer of claim 1 wherein the printing member is an inkjet.

11. The printer of claim 1 wherein the printing member is a thermal printhead.

12. The printer of claim 2 wherein the position detector further includes a rotation sensor to monitor the rotation of the platen roller and to produce the electrical signal indicative of movement of the print medium along the print medium path.

13. The printer of claim 12 wherein the rotation sensor includes:

an encoder wheel having a plurality of apertures through a portion thereof coupled to rotate in correspondence to rotation of the platen roller;

an optical source emitting light toward the portion of the encoder wheel having the apertures therethrough; and an optical detector positioned to detect light from the optical source transmitted through the apertures and producing the electrical signal in response thereto.

14. The printer of claim 13 wherein the encoder wheel is coupled to the platen roller through a gear train.

15. The printer of claim 13 wherein the encoder wheel is formed as a portion of the platen roller.

16. The printer of claim 13 wherein the encoder wheel is coupled to the platen roller through a belt.

17. A printer for printing on a print medium as the print medium is pulled through the printer by a source external to the printer, the print medium supplied from a roll of print medium carried by a print medium roll axle, the printer comprising:

a housing having a print medium path therein along which the print medium is pulled by the external source and a passageway positioned to permit the print medium to exit the housing;

a printing member within the housing and positioned adjacent the print medium path;

a rotation sensor supported by the housing and positioned to monitor rotation of the print medium roll axle as the print medium is pulled through the printer, the rotation sensor producing an electrical signal indicative of movement of the print medium along the print medium path;

a memory containing image data; and a print controller connected to receive the electrical signal from the rotation sensor and to retrieve the image data from the memory, the print controller selectively activating the printing member for printing on the print medium in response to the electrical signal and the retrieved image data.

18. The printer of claim 17 wherein the rotation sensor includes:

an encoder wheel coupled to the print medium roll axle to rotate in correspondence with the movement of the print medium;

an optical source emitting light toward the encoder wheel; and an optical detector positioned to detect light from the optical source modulated by the encoder wheel to produce the electrical signal in response thereto.

19. The printer of claim 18 wherein the encoder wheel is coaxially mounted to the print medium roll axial.

20. The printer of claim 17 wherein the print controller includes:

a second housing separate from the first housing; and a microprocessor supported by the second housing, and connected to receive the electrical signal from the rotation sensor and the image data from the memory.

21. The printer of claim 18 wherein the encoder wheel is coupled to the print medium roll axle through a gear train.

22. The printer of claim 18 wherein the encoder wheel is formed as a portion of the print medium roll axle.

23. The printer of claim 18 wherein the encoder wheel is coupled to the print medium roll axle through a belt.

24. The printer of claim 18 wherein the encoder wheel is coaxially mounted to the print medium roll axle.

25. A method of printing a plurality of image portions of an image on a manually propelled print medium, the print medium having a plurality of printing positions, comprising:

positioning the print medium in an initial printing position relative to a printing member;

manually propelling the print medium through the printer from the initial printing position to a sequence of subsequent printing positions located along the print medium subsequent to the initial printing position such that each of the printing positions passes the printing member;

as the print medium moves from the first printing position to each of the sequence of subsequent printing positions, detecting when each successive one of the printing positions is aligned with the printing member wherein detecting when each successive one of the printing positions is aligned with the printing member includes monitoring the angular rotation of a print medium roll axle carrying a supply of the print medium;

determining what image portion to print on the print medium for each printing position of the print medium; and activating the printing member in response to each determined image portion when the corresponding printing position is aligned with the printing member to produce the image portion at the printing position of the print medium.

26. A method of printing a plurality of image portions of an image on a manually propelled print medium, the print medium having a plurality of printing portions, comprising:

positioning the print medium in an initial printing position relative to a printing member;

manually propelling the print medium through the printer from the initial printing position to a sequence of subsequent printing positions located along the print medium subsequent to the initial printing position such that each of the printing positions passes the printing member;

as the print medium moves from the first printing position to each of the sequence of subsequent printing positions, detecting when each successive one of the printing positions is aligned with the printing member wherein detecting when each successive one of the printing positions is aligned with the printing member comprises:

monitoring the angular rotation of a platen roller opposed to the printing member and frictionally engaged with the print medium for rotation as the print medium is manually propelled through the printer; and in response to the monitored angular rotation, determining the position of the first printing position of the print medium relative to the printing member.

27. The method of claim 25, further comprising identifying the angular rotation of the print medium roll axle with an optical detector.

28. A method of printing an image comprising a plurality of image portions, each image portion being printed in a corresponding printing field on a print medium by a printing member controlled by a print controller, a roll of print medium supplying the print medium, comprising the steps of:

positioning the print medium in a first position relative to the printing member such that the printing member is aligned with a first one of the printing fields;

moving the print medium through the printer relative to the printing member to move a sequence of subsequent printing fields located on the print medium subsequent to the first printing field past the printing member by applying a print medium pulling force to the print medium such that each successive one of the printing fields comes into alignment with the printing member, the print medium pulling force being applied independent of control by the print controller;

detecting when each successive one of the printing fields is aligned to the printing member by monitoring the position of the print medium relative to the first position, wherein detecting when each successive one of the printing fields is aligned to the printing member includes detecting an angular rotation of a roller frictionally engaged with the roll of print medium; and for each successive one of the printing fields, energizing the printing member when the print field is aligned with the printing member to selectively print the corresponding image portion in the printing field.

29. The method of claim 28, further including applying a yielding force to the roller with a first resilient member such that the roller remains in contact with the roll of print medium during the steps of moving the print medium, detecting when each successive one of the printing fields is aligned to the printing member and energizing the printing member.

30. The method of claim 29, further including applying a yielding force to the printing member with a second resilient member such that the printing member remains in contact with the print medium during the steps of moving the print medium, detecting when each successive one of the printing fields is aligned to the printing member and energizing the printing member.

31. The method of claim 28 wherein the print medium is a processed lumber product in a lumber processing facility and the printer is incorporated in the lumber processing facility, and wherein the step of moving the print medium through the printer relative to the printing member comprises transporting the lumber product through the lumber processing facility.

32. The method of claim 28 wherein the print medium includes an adhesive portion and the step of moving the print medium through the printer relative to the printing member by applying a print medium pulling force comprises the steps of:

adhering the adhesive portion to a target object; and moving the target object relative to the printing member.

33. A printer for printing on a print medium as the print medium is pulled through the printer by a source external to the printer along a print medium path, the printer comprising:

a housing having a base and a cover, the cover pivotally mounted to the base for movement with respect thereto between an open position and a closed position;

a printing member supported by the housing;

a platen roller, the platen roller coupled to the housing for pivotal movement with respect to the printing member about a first axis to bias the print medium into frictional engagement with the print head when the cover is in the closed position;

a rotation sensor supported by the housing and positioned to monitor rotation of the platen roller as the print medium is pulled through the printer, the rotation sensor producing an electrical signal indicative of movement of the print medium along the print medium path; and a print controller coupled to receive the electrical signal from the rotation sensor and to selectively activate the printing member for printing on the print medium in response to the electrical signal.

34. The printer of claim 33 wherein the platen roller is supported by the cover and the printing member is supported by the base.

35. The printer of claim 33 wherein the platen roller is supported by the base and the printing member is supported by to the cover.

36. The printer of claim 33 wherein the rotation sensor includes:

an encoder wheel having a plurality of apertures through a portion thereof connected to rotate in correspondence to rotation of the platen roller;

an optical source emitting light toward the portion of the encoder wheel having the apertures therethrough; and an optical detector positioned to detect light from the optical source transmitted through the apertures and producing the electrical signal in response thereto.

37. The printer of claim 36 wherein the encoder wheel is coupled to the platen roller through a gear train.

38. The printer of claim 36 wherein the encoder wheel is formed as a portion of the platen roller.

39. The printer of claim 36 wherein the encoder wheel is coupled to the platen roller through a belt.

* * * * *